US005303897A

United States Patent [19]

Tengesdal et al.

[11] Patent Number: 5,303,897

[45] Date of Patent: Apr. 19, 1994

[54] ARRANGEMENT IN VALVE DAMPERS

[75] Inventors: Paul Tengesdal, Bjerkreim; Tormod Sirevåg, Sirevåg, both of Norway

[73] Assignee: Covent AS, Bjerkreim, Norway

[21] Appl. No.: 956,502

[22] PCT Filed: Jun. 21, 1991

[86] PCT No.: PCT/NO91/00089

§ 371 Date: Jan. 6, 1993

§ 102(e) Date: Jan. 6, 1993

[87] PCT Pub. No.: WO92/01180

PCT Pub. Date: Jan. 23, 1992

[30] Foreign Application Priority Data

Jul. 10, 1990 [NO] Norway ..... 903072

[51] Int. Cl.[5] ..... F16K 1/22

[52] U.S. Cl. ..... 251/85; 251/298; 251/303; 251/308; 454/333

[58] Field of Search ..... 251/84, 85, 88, 64, 251/208, 298, 303, 308; 454/333

[56] References Cited

U.S. PATENT DOCUMENTS

| | | | |
|---|---|---|---|
| 2,522,732 | 9/1950 | Whiteworth | 251/84 |
| 2,742,255 | 4/1956 | Sealey | 251/85 |
| 3,244,194 | 4/1966 | Henry | 251/303 X |
| 3,300,177 | 1/1967 | Topham et al. | 251/308 X |
| 3,587,631 | 6/1971 | Loader . | |
| 3,727,880 | 4/1973 | Stock | 251/85 |
| 3,847,373 | 11/1974 | Hagar | 251/298 |
| 3,951,130 | 4/1976 | Lowe | 454/333 X |
| 3,963,211 | 6/1976 | Myers | 251/85 |
| 4,634,094 | 1/1987 | Geiser | 251/308 X |

FOREIGN PATENT DOCUMENTS 2212972 9/1974 Fed. Rep. of Germany .

*Primary Examiner*—John Rivell

*Attorney, Agent, or Firm*—D. Peter Hochberg; Mark Kusner; Michael Jaffe

[57] ABSTRACT

There is provided a valve damper which is pivotally suspended and may in its closing position cooperate with a seat, e.g., formed in a ventilating channel, and wherein an annular seal may be placed on the damper and/or seat. In order to achieve a smoke-tight closure of the damper, the latter is connected to a pivot shaft via resilient carriers, the attachment points thereof on the damper being displaced in relation to the axis of the pivot shaft.

6 Claims, 4 Drawing Sheets

ARRANGEMENT IN VALVE DAMPERS

The present invention relates to arrangements in damper valves, especially for ventilating plants, and has more particularly for its object a distinct supporting device for the valve damper.

Usually, such a valve damper is pivotally supported on a centrically placed damper shaft, so that the pivot axis of the damper extends diametrally with a circle disc-shaped damper. However, the circumferential shape of the damper which is adapted to the cross-sectional shape of the aperture in the channel in which it is to be arranged, may also be polygonal, possibly having rounded corners, but a circular circumferential shape is normally preferred.

Such valve dampers in ventilating plants have two active extreme positions, one open position wherein the plane of the damper blade extends in the longitudinal direction of the channel, as well as a nearly closed position wherein the plane of the damper blade extends approximately perpendicularly to the longitudinal direction of the channel. However, it has hitherto be found practically impossible to achieve 100% closure with dampers of this type; in the closed position a crescent-shaped open slot will develop, extending over the major part of the circumference of the damper.

In the normal use of such damper valves in ventilating plants, this does not represent a serious disadvantage, but the fire directions require that such ventilating channels should be capable of being closed smoke-tight in case of fire or at the initial stages of a fire. Therefore, the mounting of special so-called smoke-tight dampers is required; such smoke-tight dampers thus being mounted in addition to the ordinary damper serving to regulate the air flow within the channel.

It is the object of the invention to provide a supporting device for a valve damper of the present kind wherein the damper in addition to the open adjusting positions and the approximately closed position also may be brought to take a smoke-tight closed position, so that it also fulfills the function of said additional damper and, thus, makes the latter superfluous, while satisfying the fire directions on that point.

According to the invention, this object has been realized through designing the device in accordance with the features as defined in the following claims.

The damper and/or a seat formed within the channel in which the damper is mounted, will be provided with an annular seal, in order to establish a smoke-tight bearing of the damper against the seat in the smoke-tight closed position of the damper valve, wherein optimal sealing is obtained according to the invention.

The damper shaft may be eccentrically positioned in relation to the damper, and carriers connecting damper and shaft mutually, will be resilient laterally of the plane of the damper. Thus, when the damper has been brought into the approximately closed position wherein it forms an acute angle in relation to the plane of said seat, a continued rotation of the damper shaft will cause an expansion of the U-shaped carriers, which in combination with said eccentric positioning of the damper shaft give rise to a pressing force bringing the circumferential portion of the damper/seal not yet resting against the seat/seat seal, into sealingly bearing against the same, simultaneously as the circumferential portion of the damper/damper seal already resting against the seat, is kept in position. Thereby, 100% continuous sealing between the damper or its seal and the seal of the seat or the seat itself is obtained. A special design of the damper shaft contributes to favour this sealing effect.

An example of an embodiment of the invention is further explained in the following, reference being made to the drawings, wherein.

Figure 1:
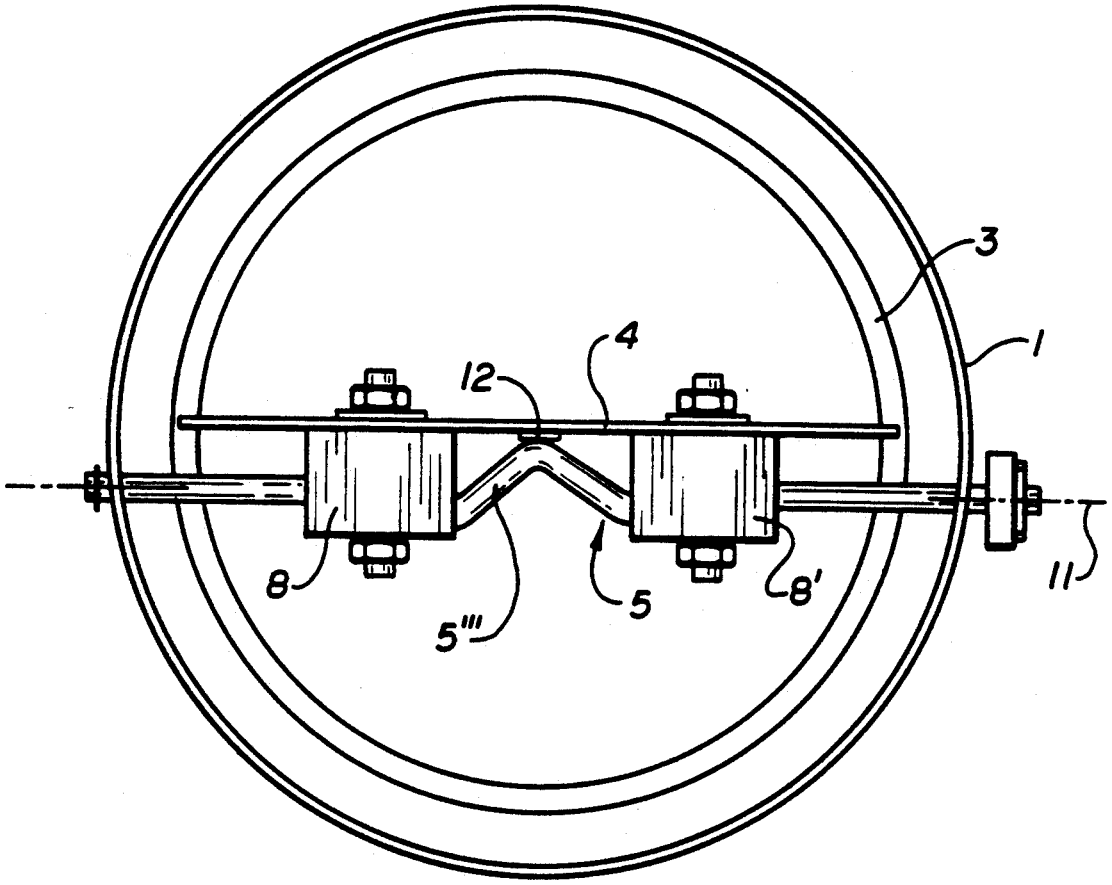
FIGS. 1 and 2 show the damper valve in elevational view in entirely open and partly closed position, respectively, the latter position corresponding to "normal" none-smoke-tight position.

In the drawings, the reference numeral 1 denotes an annular damper valve housing which may be constituted by a portion of a ventilating channel having an inwardly facing flange 1' adjoining a coaxial channel 2 having a somewhat smaller diameter and having an annular seal 3. This seal 3 may possibly be omitted in case a corresponding seal is placed at the circumferential portion of the damper, or annular seals may be used on damper as well as on seat in the channel. In the present case, said seat is formed by the annular flange 1'.

The reference numeral 4 indicates the damper which in the present embodiment has the form of a circle disc.

Figure 2:
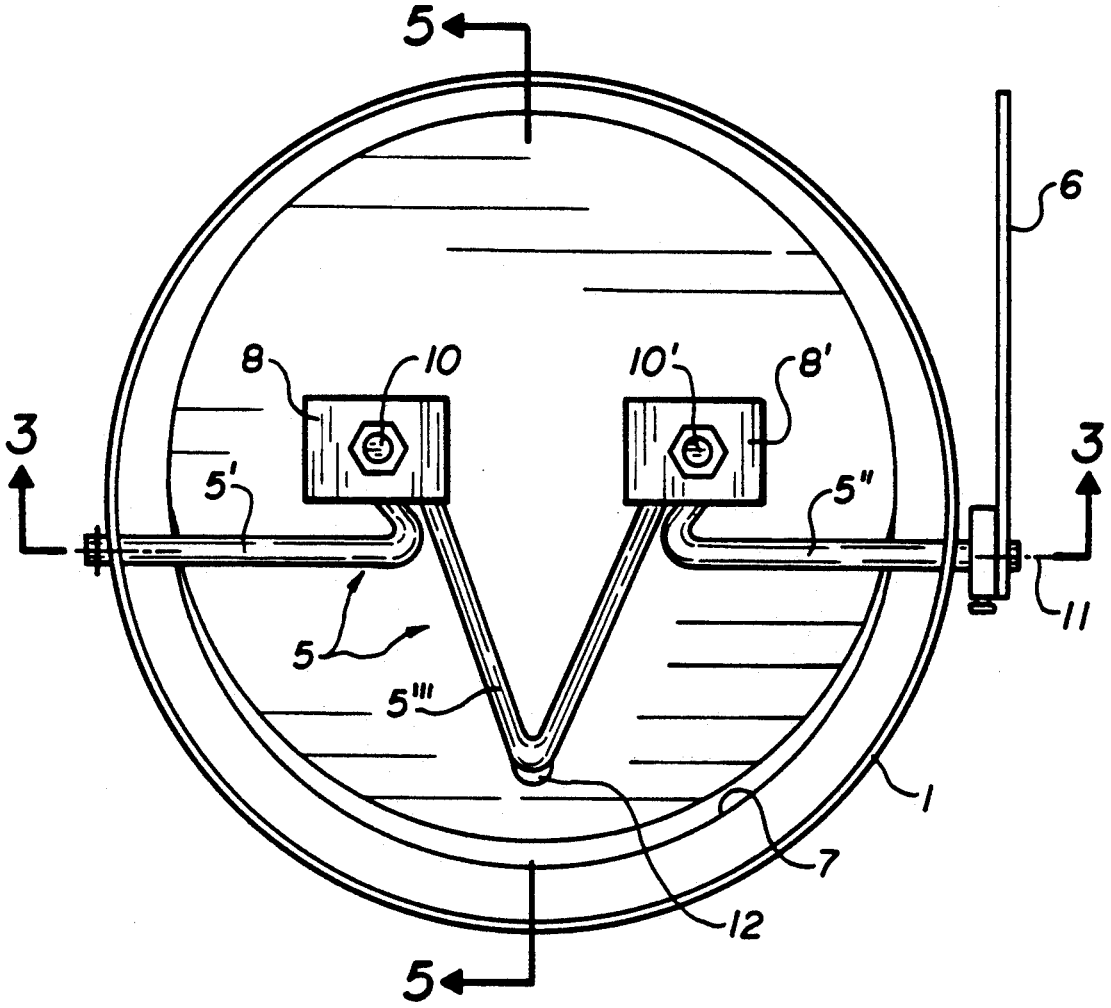
Figure 3:
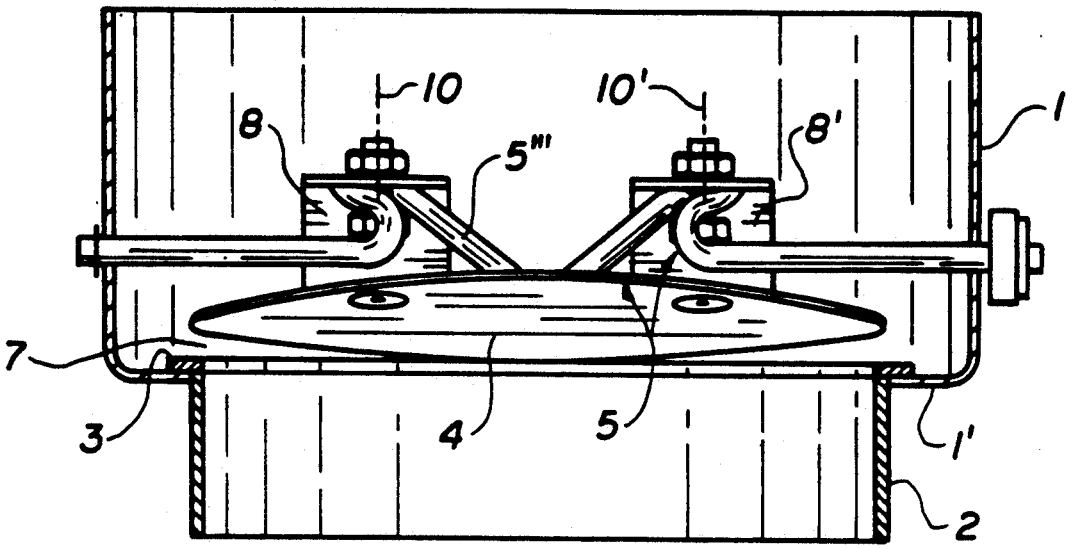
FIG. 3 shows a cross-section through the channel wall along the line III—III in FIG. 2.

The reference numeral 5 generally indicates the damper shaft. The journal thereof at one end is coupled to a moment arm 6 adapted to be rotated by means of an in per se known operating motor, not shown, in order to displace the damper 4 between the various open positions thereof, e.g. fully open position, FIG. 1, and the approximately closed position thereof, FIGS. 2, 3 and 5, wherein a crescent-shaped slot 7 develops, extending over the half or the major portion of the circumference of the damper 4, while the remaining circumferential portion of the damper rests sealingly against the seal 3, see FIG. 5.

The damper 4 is connected to the damper shaft 5 by means of two resilient U-carriers 8,8' which, according to the embodiment, are attached partly to the damper and partly to the shaft by means of screws and nuts. The attachment point on the damper 4 is represented by the (imaginary) axis 9,9' and on the shaft 5 by the axis 10,10'.

The axis of the damper shaft 5 is eccentrically placed in relation to the centre of the damper 4, and the shaft is formed in one continuous piece, having straight coaxial end portions 5',5'' and, in the area of the resilient U-carriers 8,8', being formed with connecting portions surrounding partly the fastening screws as well as having a somewhat rounded V-shaped projecting support portion 5''' in the area between the U-carriers 8,8'.

Through the eccentric suspension of the damper shaft, one damper surface at one side of the pivot axis attains a larger area than the damper surface at the opposite side of the pivot axis. In the first place, this causes the avoidance of flapping, a common unpleasant phenomenon with such damper valves, simultaneously as one has complete control over the situation in that the positioning of the damper handle will correspond to the position of the damper, because the projecting V-shaped support portion 5''' of the damper shaft will be resting supportingly against the damper blade 4 via a small circle disc 12 of suitable vibration-damping material, so that one avoids flapping of the damper blade 4 in the partly closed position thereof, FIGS. 2, 3 and 5.

Figure 5:
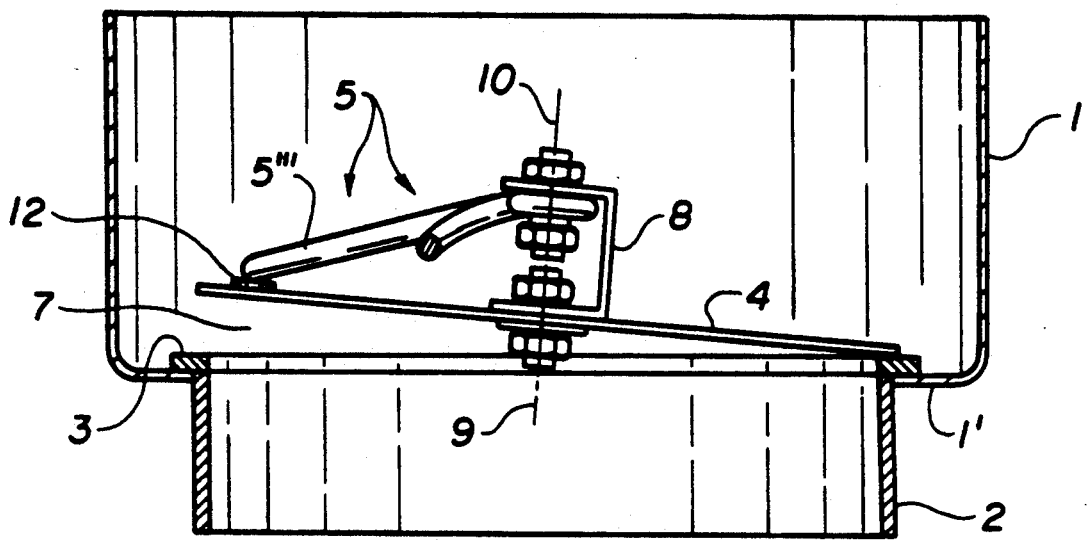
FIG. 5 shows a cross-section along the line V—V in FIG. 2.
Figure 6:
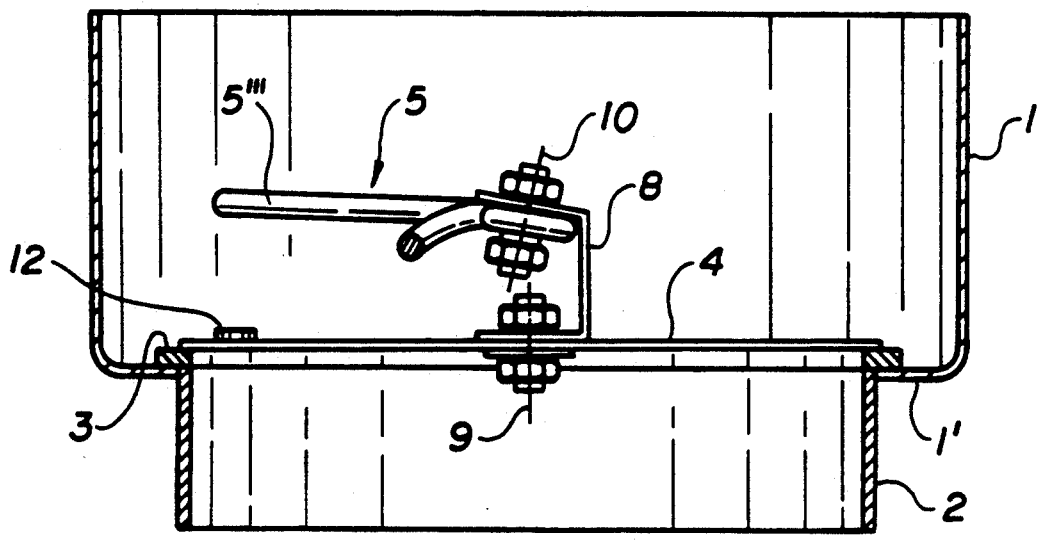
FIG. 6 shows a view corresponding to FIG. 5, but showing the damper in smoke-tight closing position according to FIG. 4.

Now, reference is made to FIG. 5 in connection with FIG. 6. FIG. 5 shows the damper blade 4 in a position corresponding to normally closed position, wherein a crescent-shaped slot 7 develops over the major part of the circumferential edge portion of the damper, said slot usually not being too troublesome. This partly closed position of the damper 4 is not always satisfactory in connection with the invention, wherein one additionally desires to have the possibility of closing the channels smoke-tightly, such as previously explained.

With continued rotation of the damper shaft 5 around the axis 11 via the moment arm 6 by means of the servo motor not shown, the relatively eccentric positioning of the damper and the pivot axis 11 thereof in combination with the resilient properties of the U-carriers 8,8′ laterally of the plane of the damper will effect a pivotal movement of the damper blade 4 supported through the special design of the damper shaft, especially the support 5‴, resulting in the damper blade 4 being pressed sealingly against the seal 3 around the entire circumference thereof.

Figure 4:
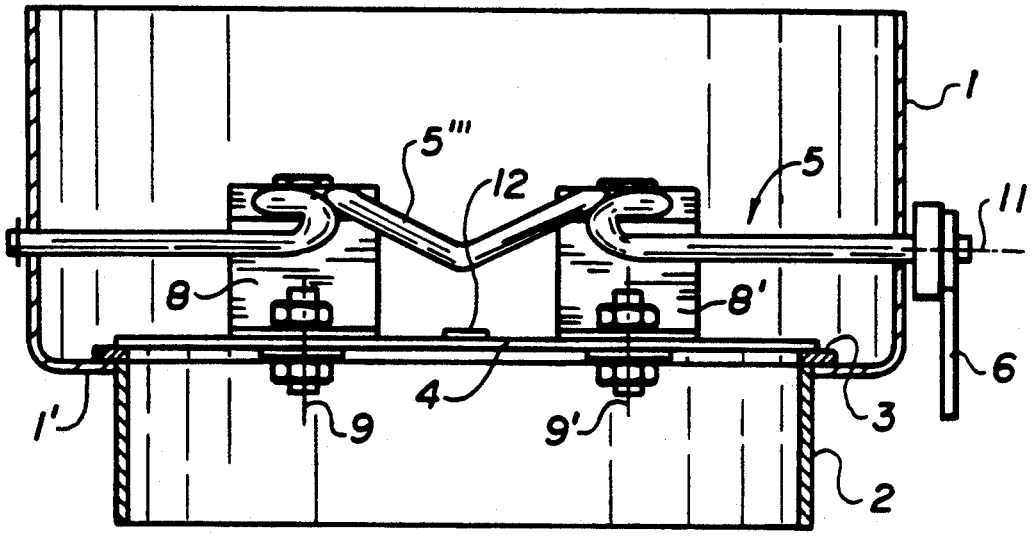
FIG. 4 shows a cross-sectional side view corresponding to FIG. 3, but showing the damper in smoke-tight closing position.

The smoke-tight closing position of the damper 4 is illustrated in FIG. 6 (as well as in FIG. 4), wherefrom appears that the U-carrier 8 has resiled outwardly, i.e. expanded, the upper U-leg portion pointing slopingly upwardly, forming an acute angle with the place of the damper blade 4. This creates a downwardly directed resilient force at the other U-leg portion thereof attached to the damper 4 at the attachment point 9. The web of the U-carriers 8,8′ serves to displace the attachment point 10 for the shaft 5 at a distance of the plane of the damper.

During the completing rotational movement of the damper shaft 5 towards the smoke-tight closing position wherein the damper shaft 5 with its support portion 5‴ is rotated in a direction away from the damper 4, there would basically be a need for an operating motor having a larger output than previously, namely in order to overcome the spring pressure from the carriers.

However, the air pressure within the ventilating channel 1,2 will cause an increasing pressure working on the damper blade 4 as the latter approaches the seal 3, and, thus, the air pressure within the channel is utilized to contribute in neutralizing the spring force opposing the closing of the damper. The air flow direction is presupposed to be from the damper valve housing towards the channel 2. Therefore, for a damper valve device according to the invention, one may use conventionally dimensioned operating motors.

We claim:

1. A damper valve arrangement for use in a ventilating plant having a ventilating duct, said damper valve arrangement comprising:

a seat formed in said duct;

rotary damper blade means for opening and closing said duct;

an operating shaft having an axis of rotation which is eccentric with respect to the geometric center of said damper blade means; said damper blade means being mounted on said shaft and rotatable about said axis between a closed position wherein said damper blade means cooperates with said seat to obtain smoke-tight closure of said ventilating duct and at least one open position for opening said duct; and resilient carrier means for connecting said damper blade means to said operating shaft, said resilient carrier means attached to said damper blade means at attachment points, said attachment points being displaced from said operating shaft axis.

2. A damper valve arrangement as defined by claim 1, wherein said resilient carrier means comprises:

a first leg for connecting said resilient carrier means to said damper blade, and a second leg for connecting said resilient carrier means to said operating shaft;

wherein said resilient carrier means has resilient properties exerting resilient forces substantially in directions lateral of the plane of said damper blade means.

3. A damper valve arrangement as defined by claim 1, wherein said resilient carrier means comprises two spaced and symmetrically placed U-shaped carriers.

4. A damper valve arrangement as defined by claim 1, wherein said operating shaft comprises:

a U-shaped or V-shaped projecting central support portion for resting supportingly against an adjacent face of said damper blade means to prevent flapping of said damper blade means.

5. A damper valve arrangement as defined by claim 4, wherein said damper blade means comprises:

vibration-damping material for resting said projecting central support portion against said damper blade means.

6. A damper valve arrangement as defined by claim 1, wherein said damper valve arrangement further comprises:

fastening means for attaching said damper blade means and said operating shaft to said resilient carrier means, wherein a portion of said operating shaft partly surrounds said fastening means.

* * * * *